United States Patent [19]

Zenner

[11] Patent Number: 4,539,905

[45] Date of Patent: Sep. 10, 1985

[54] DOT MATRIX LINE PRINTER AND PRINT ELEMENT DRIVER ASSEMBLY THEREFOR

[76] Inventor: Walter J. Zenner, 10801 Highway E - R-3, Mukwonago, Wis. 53149

[21] Appl. No.: 558,347

[22] Filed: Dec. 5, 1983

[51] Int. Cl.[3] ..... B41J 3/12

[52] U.S. Cl. ..... 101/93.05; 101/93.09; 400/124; 400/320; 400/618; 400/902

[58] Field of Search ..... 101/93.04, 93.05, 93.09, 101/93.48; 400/618, 124, 902, 320

[56] References Cited

U.S. PATENT DOCUMENTS

| | | | |
|---|---|---|---|
| 3,672,482 | 6/1972 | Brumbaugh et al. | 400/124 |
| 3,802,544 | 4/1974 | Howard et al. | 400/124 |
| 4,077,336 | 3/1978 | Talvard et al. | 101/93.05 |
| 4,192,618 | 3/1980 | Kondur et al. | 400/618 X |
| 4,200,043 | 4/1980 | Nozaki et al. | 101/93.29 |
| 4,233,894 | 11/1980 | Barrus et al. | 101/93.04 |
| 4,248,147 | 2/1981 | Zenner | 101/93.05 |
| 4,273,039 | 6/1981 | Luo et al. | 101/93.05 X |
| 4,351,235 | 9/1982 | Bringhurst | 400/121 X |
| 4,441,421 | 4/1984 | Khorsand | 101/93.04 |

*Primary Examiner*—Paul T. Sewell

*Attorney, Agent, or Firm*—Kinzer, Plyer, Dorn & McEachran

[57] ABSTRACT

A dot matrix line printer incorporates plural print element driver assemblies each including N electromagnets driving N print rods, with each electromagnet having a local magnetic circuit that includes a working air gap and a passive air gap; a permanent magnet is connected to all of the local magnetic circuits. A magnetic circuit connects all of the local passive air gaps in parallel to afford a passive air gap common to all local circuits, the reluctance of the common passive air gap being of the order of 1/N times the maximum effective reluctance of the working air gap of each electromagnet. Each armature is supported by a cantilever bias spring, biasing the armature and associated print rod away from the electromagnet poles toward a print position; a stop member progressively reduces the effective length of the cantilever spring as the armature moves toward the electromagnet poles. A one-piece shuttle engages and guides the outer ends of the print rods; the shuttle includes support arms that are flexible and resilient only in a direction parallel to the dot print line and individual print rod spring guides that are flexible and resilient only in a direction parallel to the print rod axes.

21 Claims, 10 Drawing Figures

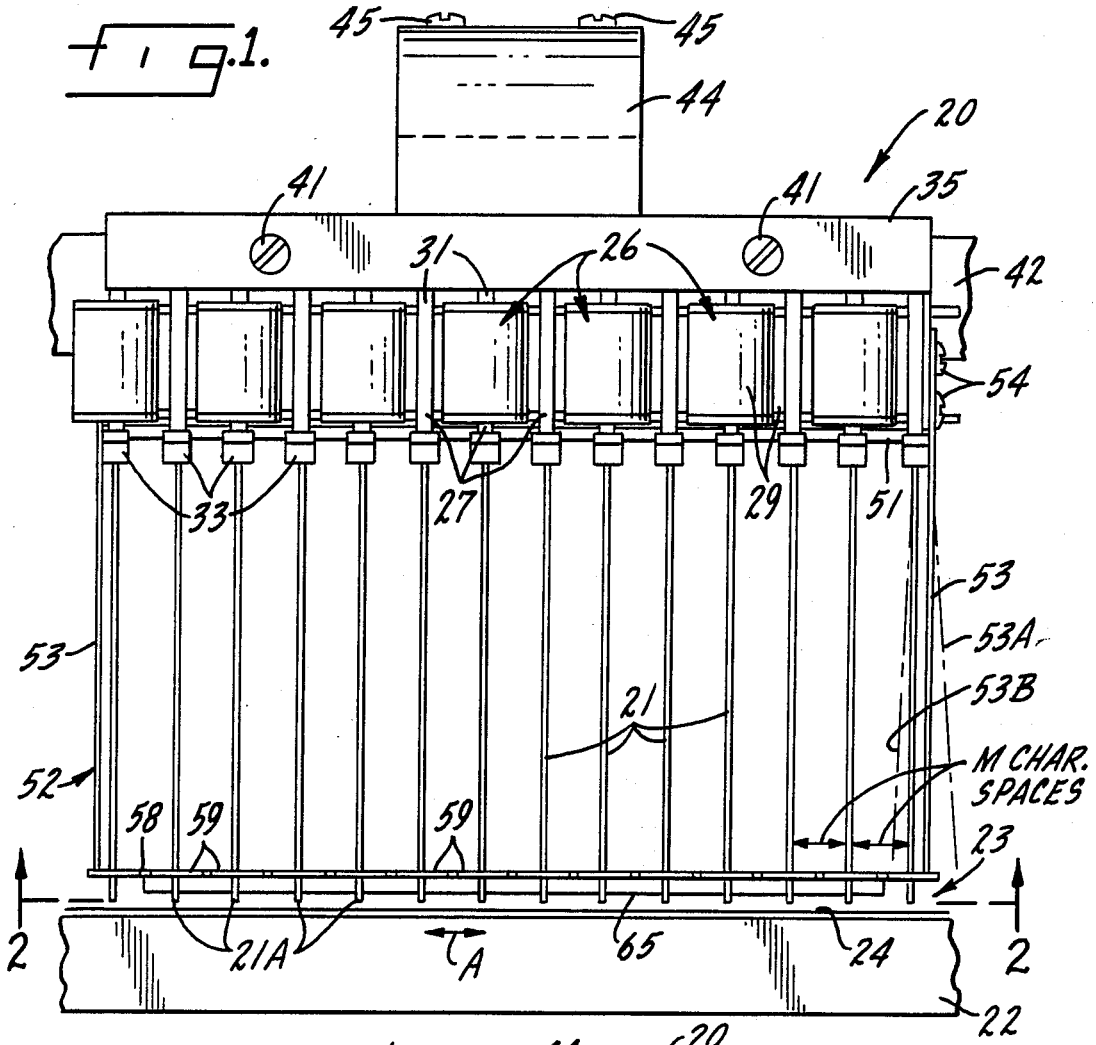
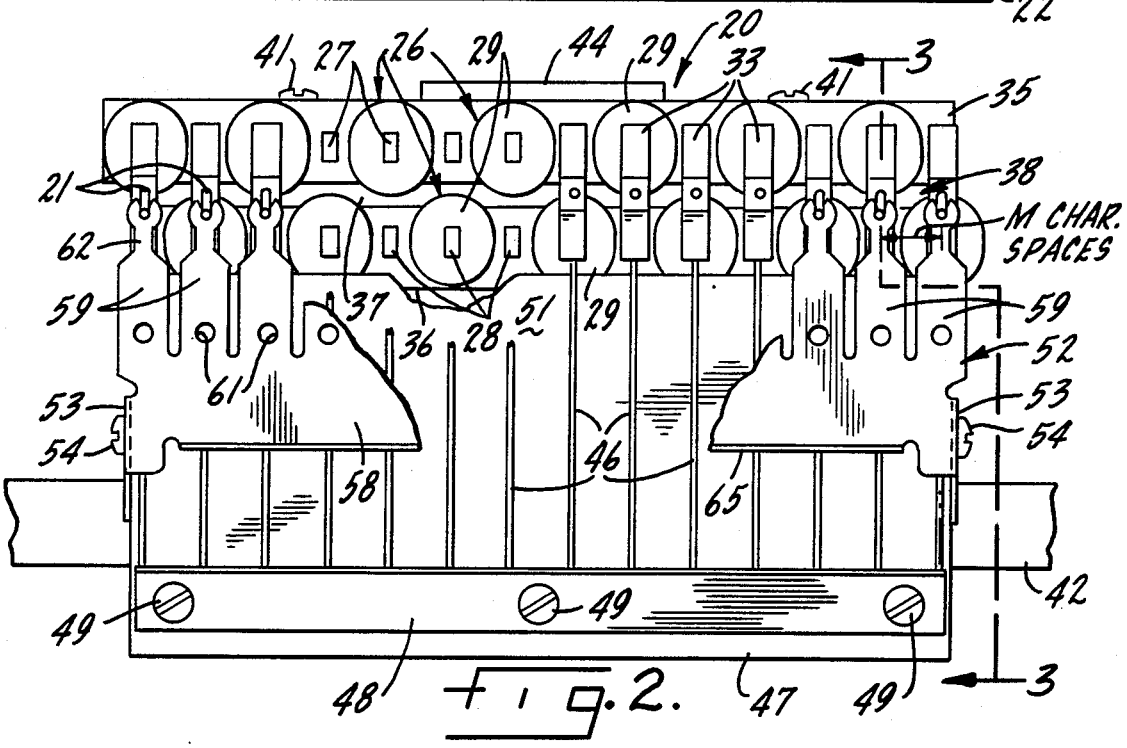
Fig. 2.

Fig. 8.
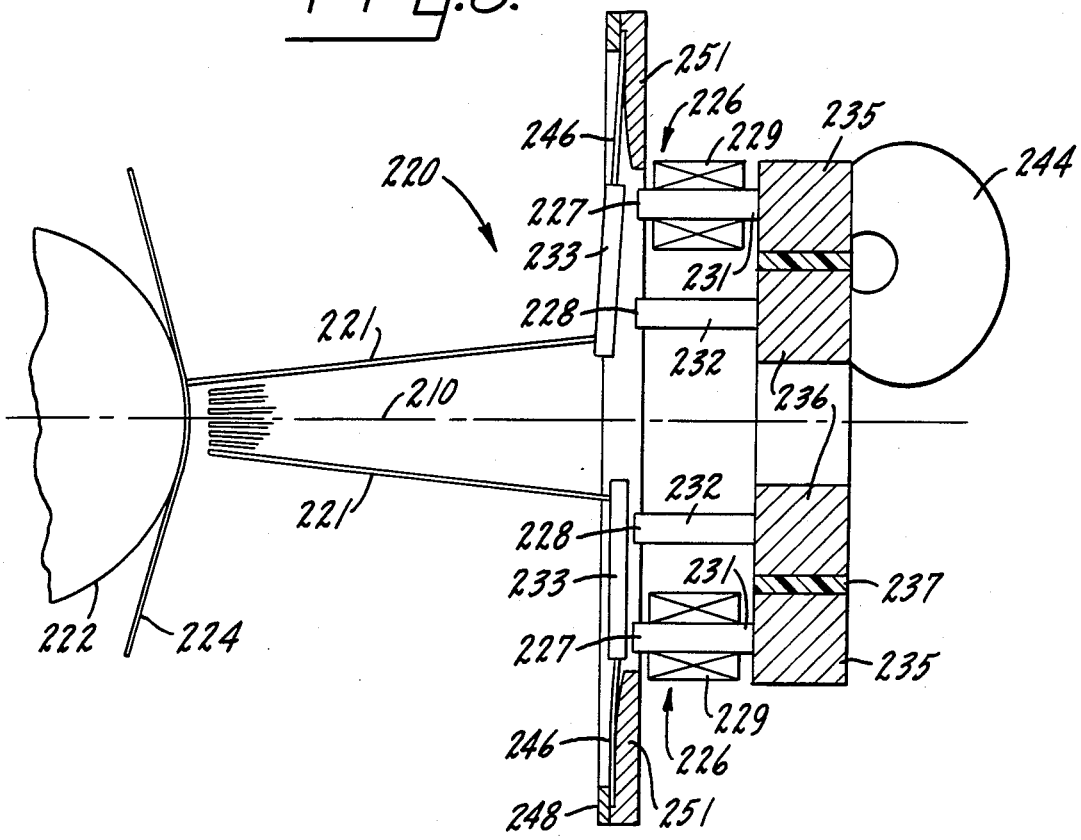
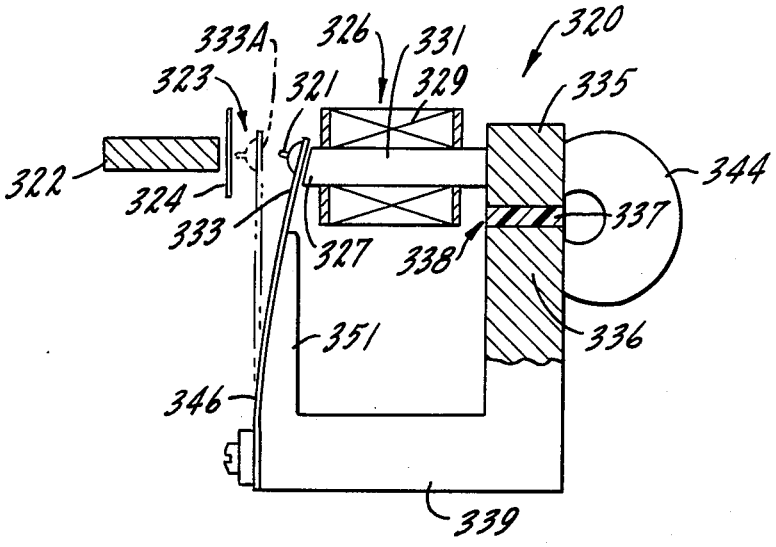
Fig. 9.

DOT MATRIX LINE PRINTER AND PRINT ELEMENT DRIVER ASSEMBLY THEREFOR

BACKGROUND OF THE INVENTION

The most common type of dot matrix printer uses a printhead that traverses the width of a sheet of paper in printing a line of text; the printhead incorporates a single column of print elements and printing is effected in a series of incremenetal movements each corresponding to the width of one dot. Examples of such column-sequential dot matrix printers are Zenner et al U.S. Pat. Nos. 3,670,861 and 3,729,070. Another type of dot matrix printer is a line printer that includes a series of N print rods or other print elements aligned along a dot print line, with the print elements displaced one or more character width spaces from each other. In such a line printer, the print elements are shifted incrementally along the dot print line through one or more character width spaces, each increment of movement being approximately equal to the width of a dot, to print the uppermost row of dots in a complete line of text; the paper is then advanced by a distance equal to one dot height and the next row of dots in the same line of text is printed, and so on until the complete line of text has been reproduced. Dot matrix line printers of this kind are disclosed in Howard U.S. Pat. No. 3,802,544 and in Zenner U.S. Pat. No. 4,248,147. The present invention is primarily concerned with dot matrix line printers, but some of the features of the present invention can also be applied to column-sequential printers.

One effective driver mechanism for a print rod or similar dot matrix impact print element utilizes an electromagnet and a permanent magnet in combination in a shared magnetic circuit. In a device of this kind, the armature of the electromagnet is spring biased from an attracted position immediately adjacent the pole or poles of the magnetic circuit toward a released position substantially separated from the magnet poles; usually, the attracted position is the non-print position and the extended position is the print position for the device. The permanent magnet is used to hold the armature in its attracted position and the electromagnet coil is energized to overcome the magnetic force of attraction exerted by the permanent magnet, releasing the armature to move to its print position and drive a print rod or other print element through a printing movement. Examples of this particular kind of permanent magnet-/electromagnet driver mechanism, as used in dot matrix printers, are disclosed in Brumbaugh et al U.S. Pat. No. 3,672,482 and Barrus et al U.S. Pat. No. 4,233,894.

This type of print element driver is capable of high speed operation, but frequently exhibits some undesirable attributes. Thus, the permanent magnet is usually connected in series in the magnetic circuit of the electromagnet, as shown in both of the aforementioned patents. With this arrangement, the high reluctance of the permanent magnet materially increases the number of ampere turns that must be developed by the electromagnet coil in order to overcome the bias force exerted by the permanent magnet, so that the device is inherently inefficient with respect to energy consumption. As a consequence, devices of this kind tend to require inordinate levels of energization and may run hot. This difficulty can be overcome by changing the magnetic circuit so that the permanent magnet is connected in parallel with the electromagnet as in Luo et al U.S. Pat. No. 4,273,039. On the other hand, that arrangement usually requires energization of the electromagnet in opposite polarities in order to afford effective operation, increasing the complexity of the energizing circuits for the electromagnet and reducing the efficiency of the device with respect to energy consumption.

In electromagnetic print element drivers that utilize permanent magnets in combination with electromagnets, the armatures have frequently been mounted upon cantilever springs; the cantilever spring serves as a support for the armature of the device and also provides the biasing force that drives the armature and its associated print element from the attracted non-print position to the released print position. A spring of this type normally has a straight line characteristic, whereas in a typical magnet the force exerted on the armature increases inversely as the square of the length of the armature air gap. Consequently, the device fails to utilize the full available force of the permanent magnet in attracting the armature to its initial non-print position. Furthermore, the armature usually terminates its movement to attracted position with substantial impact and with a tendency toward undesirable vibration and secondary motions, since the attractive force of the permanent magnet continues to increase as the armature approaches its attracted position.

In a dot matrix line printer, friction and inertia present major difficulties with respect to movements of the print elements. For high speed printing operations, the movements required of all of the print elements, reciprocating along a dot print line in the printing of successive rows of dot elements, make any increment of added weight and any friction in the drive mechanism highly critical. Conventional reciprocating support structures for the ends of the print rods or like print elements at the print station impose relatively severe limitations on the print rate and frequently lead to inaccuracies in the printed characters, as by misalignment of the columns of dots in the reproduced characters and like effects. On the other hand, precision feeding of the paper is essential to good print quality in a dot matrix line printer, and precise control of the tiny (dot height) increments of paper movement that are essential to a printer of this kind has been extremely difficult to obtain in a line printer operated at a high print rate.

SUMMARY OF THE INVENTION

It is an object of the present invention, therefore, to provide a new and improved polarized electromagnetic/permanent magnet driver assembly for a dot matrix printer or other recorder that affords improved efficiency of energy consumption without the necessity of providing for energization of the electromagnet coil in opposite polarities. In this aspect the invention is applicable to a dot matrix line printer, to a column sequential dot matrix printer, and to other recorders.

Another object of the invention is to provide a new and improved stop construction for use with a cantilever support spring for a magnetic print element driver in a dot matrix printer that matches the effective spring characteristic to the attractive force characteristic of the magnet in order to provide maximum efficiency in utilization of the magnet and to minimize impact forces and bouncing or other extraneous motions of the armature upon movement to a attracted position. Again, in this aspect the invention is applicable to a line printer and to a column sequential printer.

Another object of the invention is to provide a new and improved shuttle, for use in supporting and guiding the print elements in a dot matrix line printer, that effectively minimizes or eliminates friction effects and that reduces the overall weight and inertia of the shuttle to a minimum. A related object of the invention is to provide a new and improved shuttle that can be fabricated from a single, unitary sheet of thin, resilient metal.

An additional object of the invention is to provide a new and improved paper feed mechanism for a dot matrix line printer that effectively eliminates or minimizes drag on the incremental (dot height) movements of a paper web being advanced through the print station of the printer and that maintains a constant, precise control of tension on the paper as the paper advances through the print station.

A specific object of the invention is to provide a new and improved dot matrix line printer that is simple and inexpensive in construction, highly energy efficient, and capable of operation at high print rates.

Accordingly, in one aspect the invention relates to a polarized electromagnet/permanent magnet driver assembly for a recorder that comprises N electromagnets, with each electromagnet including an armature and magnetic core means affording a local magnetic circuit including a working air gap and a local passive air gap, the armature being aligned with the working air gap and movable between an attracted position and a released position, and an electrical coil, mounted on the core means, for generating a magnetic flux in the local magnetic circuit. The driver asembly further comprises N recording elements, each actuated by movement of one of the armatures from one of its positions to the other, magnetic circuit connection means interconnecting all of the local magnetic circuits with their local passive air gaps in parallel to form a common passive air gap, and a permanent magnet connected to the magnetic circuit connection means, across the common passive air gap.

In another aspect the invention relates to a dot matrix line printer of the kind compring N dot print elements aligned in spaced relation to each other along a dot print line across a recording sheet of paper or the like at a print station, and drive means for actuating each dot print element; the improvement of the invention comprises N flexible print element guides, each individually supporting one of the print elements for printing movements substantially normal to the recording sheet, and flexible supporting means for supporting all of the print elements for motion in unison along a line parallel to the dot print line.

In yet another aspect the invention relates to a dot matrix line printer of the kind comprising N dot print elements aligned in spaced relation to each other along a dot print line across a recording sheet of paper or the like at a print station, and drive means for actuating each dot print element; the improvement of the invention comprises a continuous web paper supply, dot increment paper advance means for cyclically advancing the paper web through the print station in a series of incremental movements, each incremental movement being of the order of one dot height, and line feed paper advance means for cyclically advancing the paper web from the supply toward the print station in larger increments, the line feed and dot incremental advance cycles being co-ordinated so that the two paper advance means each advance the paper at the same average rate.

BRIEF DESCRIPTION OF THE DRAWINGS

FIG. 1 is a plan view of a polarized electromagnet/-permanent magnet print element driver assembly for a dot matrix line printer, constructed in accordance with a preferred embodiment of the present invention;

FIG. 2 is a front elevation view of the print element driver assembly taken approximately as indicated by line 2—2 in FIG. 1;

FIG. 8 is a partially schematic sectional elevation view of a printhead for a column sequential dot matrix printer incorporating some of the unique features of the print element driver assembly of FIGS. 1–3; and FIG. 9 is a simplified sectional elevation view of another embodiment of a print element driver assembly for a line printer incorporating features of the invention.

DESCRIPTION OF THE PREFERRED EMBODIMENTS

Figure 3:
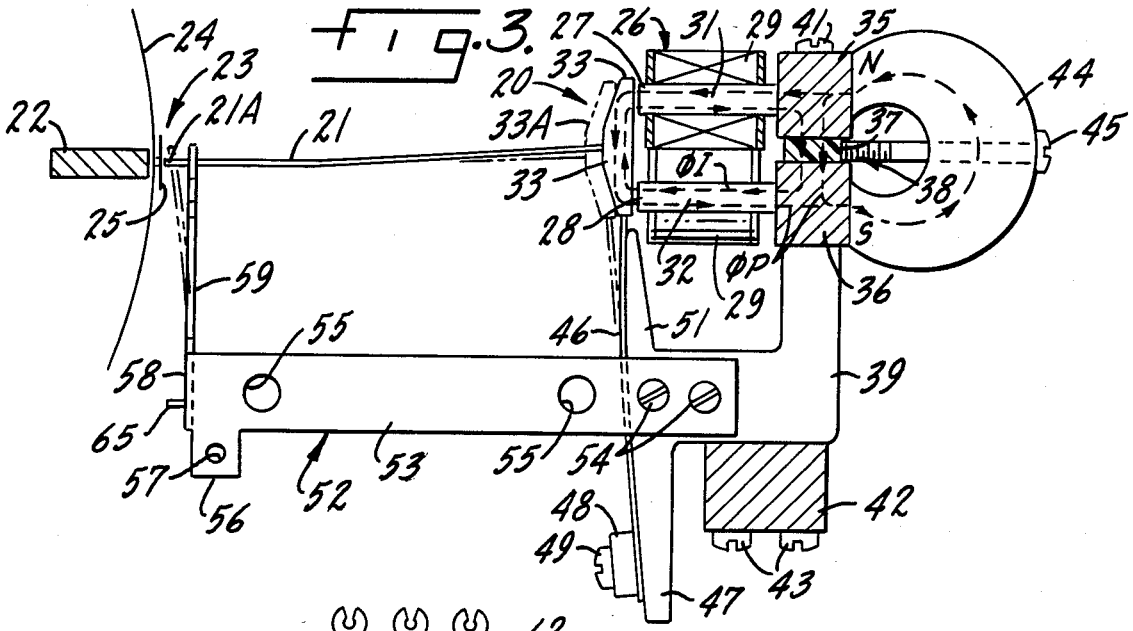
FIG. 3 is a partially sectional side elevation view of the print element driver assembly taken approximately as indicated by line 3—3 in FIG. 2.

FIGS. 1, 2 and 3 illustrate a polarized electromagnet/permanent magnet driver assembly 20 constructed in accordance with a preferred embodiment of the present invention; assembly 20 is used in a dot matrix line printer. Driver assembly 20 includes N print elements 21, each an elongated, needle-like print rod. As shown in FIGS. 1 and 2, N=14 in assembly 20. The outer ends 21A of print elements 21 are linearly aligned along a dot print line facing a platen 22 at a print station 23 (FIGS. 1 and 3). Driver assembly 20 is part of an impact printer; print elements 21 are utilized to imprint a line of dots across a paper sheet 24 which extends across platen 22. Sheet 24 may be of impact-sensitive paper, or printing may be effected with a ribbon 25 (FIG. 3).

The print element driver assembly 20 includes N electromagnets 26 (FIGS. 1–3), one for each print rod 21. Each electromagnet incorporates magnetic core means comprising two magnetic core members 31 and 32 having two spaced, aligned end surfaces 27 and 28, respectively. The two magnetic core members 31 and 32 are a part of a local magnetic circuit for the electromagnet. An electrical coil 29 is included in each electromagnet 26; coils 29 are alternately mounted on core members 31 and 32, in adjacent electromagnets, the staggered arrangement for the coils being best shown in FIGS. 2 and 3.

Each electromagnet 26 includes an armature 33 that is a part of its local magnetic circuit and is movable between two operating positions, as best shown in FIG. 3. The first operating position for armature 33, shown in solid lines in FIG. 3, is an attracted position with a minimum (negligible) total working air gap between the armature and the two end surfaces 27 and 28. The second operating position is illustrated by the phantom outline 33A in FIG. 3 and is characterized by a maximum total working air gap between the armature and the magnet core. Each print element 21 is affixed to one of the armatures 33 so that the print element is actuated from a normal non-print position to a print position by movement of the armature from its attracted position to its released position 33A.

Even with armature 33 in its non-print or attracted position as shown in FIG. 3, it will be apparent that the local magnetic circuit for each electromagnet 26, as thus far described, is incomplete at the ends of the core members 31 and 32 opposite end surfaces 27 and 28. The local magnetic circuits for the electromagnets 26 are all interconnected and completed by magnetic circuit connection means comprising two low-reluctance magnetic buses 35 and 36. All of the upper core members 31 of the electromagnets are affixed to the upper magnetic bus 35. Similarly, all of the lower core members 32 are affixed to the lower magnetic bus 36. A non-magnetic spacer 37 interposed between the two magnetic buses 35 and 36 affords a passive air gap 38 between the two magnetic buses; the passive air gap 38 is common to all of the local magnetic circuits of electromagnets 26. Stated differently, each local magnetic circuit includes both a working air gap, for armature 33, and a local passive air gap, with all of the local passive air gaps connected in parallel as a common passive gap 38 for all of the electromagnets.

The dimensions of the common passive air gap 38 should be selected so that the reluctance of that gap is of the order of 1/N times the maximum reluctance of the total working air gap between any one of the armatures 33 its associated magnet poles 27 and 28; that maximum reluctance for the armature portion of the magnetic circuit is determined, of course, by the released or print position 33A for the armature.

Magnetic buses 35 and 36 and spacer 37 are mounted upon a rigid frame member 39 by suitable means such as a plurality of non-magnetic bolts 41. In a dot matrix line printer that utilizes more than one of the print element driver assemblies 20, as discussed hereinafter in connection with FIG. 6, frame 39 may be mounted upon a transverse support member 42 by appropriate means such as the bolts 43 (FIG. 3). Drive assembly 20 (FIGS. 1–3) further comprises a permanent magnet 44 that is mounted upon the assembly by means of a pair of bolts 45 secured to the non-magnetic spacer 37; see FIGS. 1 and 3. The north pole of the permanent magnet 44 engages magnetic bus 35 and the south pole engages magnetic bus 36, as shown in FIG. 3. This polarity connection is not critical; it can be reversed. As will be apparent from FIG. 3, the common passive air gap 38 is a part of the magnetic circuit of permanent magnet 44 as well as the individual local magnetic circuits of electromagnets 26.

In print element driver assembly 20 each armature 33 is provided with bias means effectively biasing the armature toward its released or print position 33A. In the construction shown in FIGS. 1–3, this bias means comprises a cantilever armature bias and support spring 46 for each armature; each armature is mounted on the upper free end of its cantilever spring 46 and the lower end of the spring is secured to a downwardly extending portion 47 of frame member 39 by appropriate means such as a clamp bar 48 and a plurality of bolts 49.

Assembly 20 further includes stop means for limiting return movement of each armature 33 from its released print position 33A to its attracted non-print position. This stop means comprises a stop member 51, formed as an integral part of the assembly frame member 39, that is engaged by each of the armature bias and support springs 46 as most clearly illustrated in FIG. 3. Thus, it is stop member 51 that determines the attracted position for each armature 33.

In driver assembly 20, as shown in FIG. 1, the outer ends 21A of print rods 21, remote from armatures 33, are displaced M character width spaces from each other along the dot print line defined by the print rods at print station 23. M may be any small integer up to about four; preferably, $M=2$. For a printer printing dot characters having a nominal maximum width of five dots (e.g., a $5\times7$ matrix) with two dot width spaces between characters, the total distance between each adjacent pair of print elements 2 would be fourteen dot 1 widths. For a printer utilizing a larger dot matrix to print characters of better quality or greater complexity, such as a $9\times12$ matrix, the total spacing between each pair of adjacent print elements may be twenty-two dot widths. In operation of a printer incorporating assembly 20, therefore, it is necessary to shift at least the ends 21A of the entire group of N print elements 21 along the dot print line, longitudinally of platen 22 and transversely of paper web 24, through a total distance approximately equal to the spacing between adjacent print elements 21. This is accomplished by means of a flexible shuttle 52 actuated by an appropriate shuttle drive means as described hereinafter in connection with FIG. 6.

Shuttle 52 comprises two cantilever support arms 53 each having one end affixed to frame member 39 by appropriate means such as the bolts 54. Each shuttle support arm 53 is formed of a thin sheet of flexible and resilient metal. In the preferred construction each arm 53 is provided with two apertures 55 to afford flexure points in the support arm; see FIG. 3. Support arms 53 extend parallel to print rods 21 and the outer free ends of the support arms 53 are adjacent to but spaced from the opposite ends of the dot print line defined by the outer ends of the print rods adjacent platen 22. With the described construction, each support arm 53 is resilient and flexible in a direction parallel to the dot print line; on the other hand, each support arm 53 is quite rigid in any direction transverse to the dot print line. The maximum limits for deflection of arms 53 are indicated in FIG. 1 by phantom lines 53A and 53B.

The outer end of each shuttle support arm 53 is provided with a vertically depending extension 56 which includes an aperture 57 (FIG. 3). Extension 56 and aperture 57 are utilized to couple shuttle 52 to the shuttle of an adjacent print element driver assembly, like assembly 20, in a line printer utilizing a plurality of such assemblies as described hereinafter in connection with FIG. 6.

Shuttle 52 further comprises a shuttle member 58 that is affixed to and interconnects the free ends of the two shuttle support arms 53 as best shown in FIG. 2. There are N print rod guides 59 in assembly 20, each print rod guide 59 being affixed to and projecting upwardly from shuttle member 58 into engagement with the outer end of one of the print rods 21. As best shown in FIG. 2, each print rod 21 projects through and is firmly held in a small slot in the upper end of its associated print rod guide 59; see also FIG. 3. Each print rod guide 59 is formed of thin, flexihle, resilient sheet metal and has a substantial width so that the print rod guide is flexible and resilient in a direction permitting axial movement of its associated print rod but is essentially rigid in any direction transverse thereto. As shown in FIG. 2, each print rod guide 59 includes an aperture 61 and a narrow neck 62; these structural features of the print rod guides afford flexure points to increase the flexibility of each guide in a direction parallel to the axis of its 0ssociated print rods 21. It is the guides 59 that support the outer ends of the print rods 21.

Figure 4:
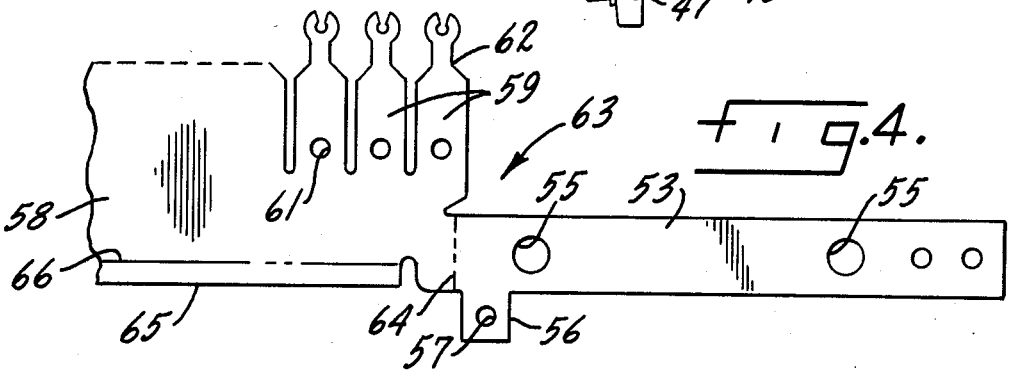
FIG. 4 is a detail illustration of a blank utilized in fabrication of a shuttle incorporated in the print element driver assembly of FIGS. 1–3.

The entire shuttle 52, comprising cantilever support arms 53, shuttle member 58, and print rod guides 59, is preferably constructed from a single thin sheet of flexible, resilient metal. Resilient stainless spring steel may be employed, though other metals are acceptable. The basic construction can be most clearly visualized from the portion of a shuttle blank 63 illustrated in FIG. 4. The part of blank 63 shown in FIG. 4 includes the cantilever arm 53 for the right-hand side of shuttle 52 as shown in FIGS. 1 and 2 together with the portion of shuttle member 58 immediately adjacent that arm 53; the other end of blank 63 would exhibit the same structural features except that it would be a mirror image of the portion illustrated. To complete formation of shuttle 52, after punching out blank 63, the cantilever support arms 53 are bent away from shuttle member 58 along fold lines such as the fold line 64. A stiffening lip 65 on shuttle member 58 is folded outwardly along fold line 66. This one-piece construction for the shuttle is simple and inexpensive to fabricate and affords a shuttle that is light in weight yet provides adequate strength where required.

In operation of driver assembly 20, FIGS. 1–3, when none of the electromagnet coils 29 is energized, each armature 33 is pulled up to its attracted position as shown in solid lines in FIG. 3 by the magnetic force of attraction provided by permanent magnet 44. Starting at the north pole of magnet 44, the magnetic circuit for the permanent magnet flux ØP extends through magnetic bus 35 and electromagnet core member 31 to surface 27 and then across the upper half of the working air gap to armature 33. From armature 33, the permanent magnet circuit continues across the lower half of the working air gap from armature 33 to surface 28 and thence through core member 32 and magnetic bus 36 to the south pole of permanent magnet 44. There is also a parallel path for the permanent magnet flux ØP, extending from the north pole through magnetic bus 35 and passive air gap 38 to bus 36 and back to the south pole of the permanent magnet. Because the reluctance of the bypass air gap 38 is about equal to the total reluctance of all of the armature (working) gaps in parallel, the permanent magnet flux through the passive gap 38 is about equal to the total useful permanent magnet flux used to attract the armatures 33 to their retracted, first positions. Since the magnetic cross sectional area of the permanent magnet and of the magnetic buses 35 and 36 is quite large, this does not adversely affect the remainder of the system.

To print a dot, the coil 29 of one electromagnet 26 is energized, producing a magnetic flux in the local electromagnetic circuit as indicated by the flux path ØI in FIG. 3. This local magnetic circuit, starting with core member 31, extends to magnetic bus 35 and across the passive air gap 38 to bus 36, then through core member 32 and surface 28 to armature 33 and back from the armature to surface 27 of core member 31. To print, the electromagnetic flux ØI should be approximately the same in magnitude as the permanent magnet flux ØP in the same local circuit, but opposite in polarity as shown. With coil 29 energized, the attractive force normally exercised by permanent magnet 44 is effectively cancelled, and armature 33 is driven from its attracted position to its extended, released print position 33A by its associated bias and support spring 46.

The reluctance of a permanent magnet, such as magnet 44, is quite high, about the same as that of air. If the electromagnet flux ØI were required to pass through permanent magnet 44, as in conventional series-connected permanent magnet/electromagnet drivers, the energization level of coil 29 would have to be extremely high merely to produce the required flux ØI through the high reluctance presented by the permanent magnet. This requirement is negated by the presence of bypass air gap 38. Thus, for each electromagnet 26 the passive air gap 38 is the only appreciable reluctance added to the usual armature working air gap reluctance. Because the reluctance of N working air gaps in parallel is 1/N times that of a single armature air gap, the reluctance of the passive air gap 38 may be made quite low. Thus, in driver assembly 20, with fourteen armatures, the reluctance of air gap 38 may be made about one-fourteenth of the total maximum working air gap reluctance for each armature. Stated differently, the illustrated construction requires no significant additional ampere turns for the flux ØI from elecromagnets 26 to overcome losses in permanent magnet 44, whereas in a construction lacking bypass gap 38 an increase of several hundred percent would be required.

In a dot matrix line printer with an electromagnet driving the print element for each dot column, this effect of the passive air gap 38 becomes quite important because it materially reduces the overall power requirements for the print element driver assembly. In addition to a major increase in energy consumption efficiency, heat dissipation problems in driver assembly 20 are minimized; the operating temperature is also minimized. Nevertheless, the size of the magnetic components is not increased; indeed, components such as cores 31 and 32 may be kept to minimal size. The combination of series and parallel connections from permanent magnet 44 relative to the individual magnetic circuits of electromagnets 26 also eliminates any need for reverse energization of electromagnet coils to pull armatures 33 back to their original positions when they have completed printing movements.

In the operation of print element driver assembly 20, as previously noted, print rods 21 are moved, in a direction parallel to the dot print line formed by the ends of the print rods, in order to print a row of dots on paper 23. This action must be repeated for each row of dots in the characters being printed. Thus, in a printer utilizing a $9 \times 12$ matrix, this operation is repeated twelve times in the course of printing one line of text. After each horizontal movement of the array of print elements 21, the paper is advanced one dot height to be in position for the next row of dots in the characters being printed.

For reasonably high speed printing operations, it can be seen that the shuttle must be reciprocated quite rapidly between limits 53A and 53B; see arrows A, FIG. 1. Thus, weight becomes an important factor; the heavier the shuttle, the more force required to effect a shuttle scan and the more difficult it is to provide the requisite precision control. By the same token, any friction occurring in the course of shuttle operation has an adverse effect. Shuttle 52 affords a substantially frictionless arrangement that is extremely light in weight, yet adequately rigid in the required directions, and hence constitutes a major improvement over more conventional shuttle structures.

Another advantage of the print element drive assembly 20 is the flexibility that assembly provides for modular construction of line printers of varying widths. Thus, two, three, or more such drive assemblies can have their shuttles 52 interconnected, using the extensions 56 on each of the shuttle support arms 53. Accordingly, if a single drive assembly 20 affords just twenty-eight characters of line width, suitable for an application such as a cash register tape, two such modular drive asemblies connected together provide a fifty-six character line suitable for use with six inch paper. Three such drive assemblies, connected together on a modular basis, will print a line of eighty-four characters, an adequate number for a line of text on standard stationery. Five such driver assemblies may be connected together as modules in a line printer accepting wide ledger paper. These suggested arrangements for recording sheets of varying widths are based on the assumption that $M=2$, so that each shuttle movement covers two character widths. The illustrated assembly construction, with its staggered mounting of coils 29 on cores 31 and 32, is also advantageous because it makes it possible to use relatively large electromagnet coils that can be conveniently wound on automatic machines. Of course, the number N of print elements and electromagnets in each modular driver assembly can be varied to suit design requirements. However, it is usually preferable that N be at least ten or more in order to take full advantage of the attributes of the passive gap in the magnetic circuits of the driver assembly as discussed above.

Figure 5A:
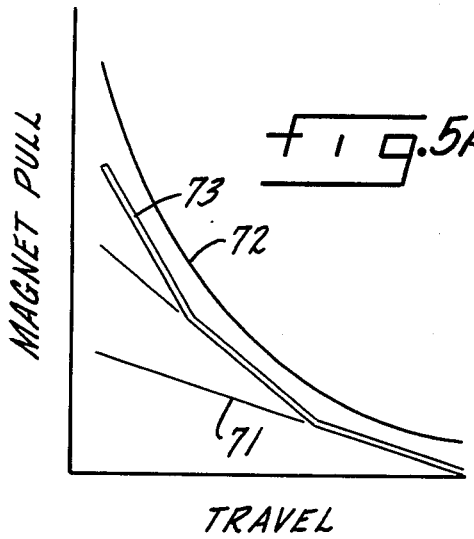
FIGS. 5A and 5B are explanatory diagrams utilized to explain operational characteristics of an armature stop incorporated in the print element driver assembly of FIGS. 1–3.

As previously noted, each armature 33 in assembly 20 is supported upon its associated bias and support spring 46. Springs 46 are preferably wire springs. A cantilever wire spring of this type, operating with no modification of its effective length, provides an essentially linear force/travel characteristic as indicated by the straight line curve 71 in FIG. 5A. This is in direct contrast to a typical magnet attraction force/travel characteristic as indicated by curve 72. More specifically, the "pull" curve for a magnet, curve 72, increases inversely as the square of the air gap length, which corresponds to the armature travel. Accordingly, a normal spring operating with a straight line characteristic 71 fails to utilize the full force of the magnet.

Ideally, each bias and support spring 46 should afford a force/travel characteristic essentially paralleling that of the magnet, in this instance the permanent magnet 44. By adding at least two stops to shorten the effective length of the spring in progressive steps as the armature approaches its initial retracted position, the resulting spring characteristic, represented by curve 73 in FIG. 5A, more closely approaches that of the magnet characteristic, curve 72. By utilizing a smooth curve effectively affording an infinite number of stops, a spring characteristic essentially parallel to the magnet pull curve can be achieved. This is the construction utilized for stop 51 as shown in FIG. 3 and shown on an enlarged scale in FIG. 5B.

Figure 5B:
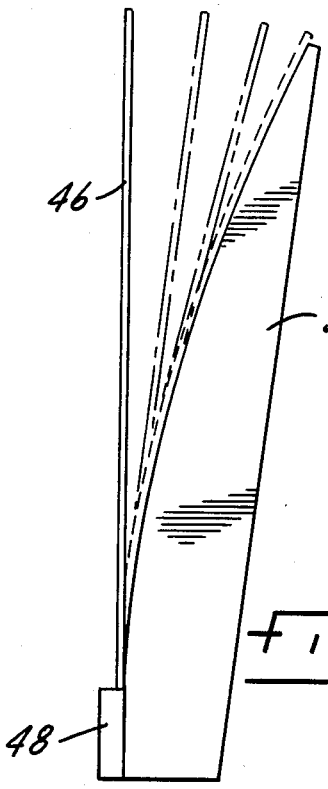

This configuration for spring stop 51 has additional advantages. Of primary importance, there is little or no impact at the time the armature reaches the end of its travel from its released print position 33A back to its initial attracted position (FIG. 3). The usual cantilever spring support for a magnet armature, with no progressive modification of the effective spring length, finishes its travel with a substantial impact. The progressive decrease in effective spring length afforded by stop 51, FIG. 5B, provides a smooth stop. Furthermore, the contact between spring 46 and the curved stop 51 suppresses vibration and secondary motions. Spring stop 51 is preferably formed as a part of a die casting, integral with frame member 39 (FIG. 3), and serves all of the armature springs in the modular driver assembly 20.

Figure 6:
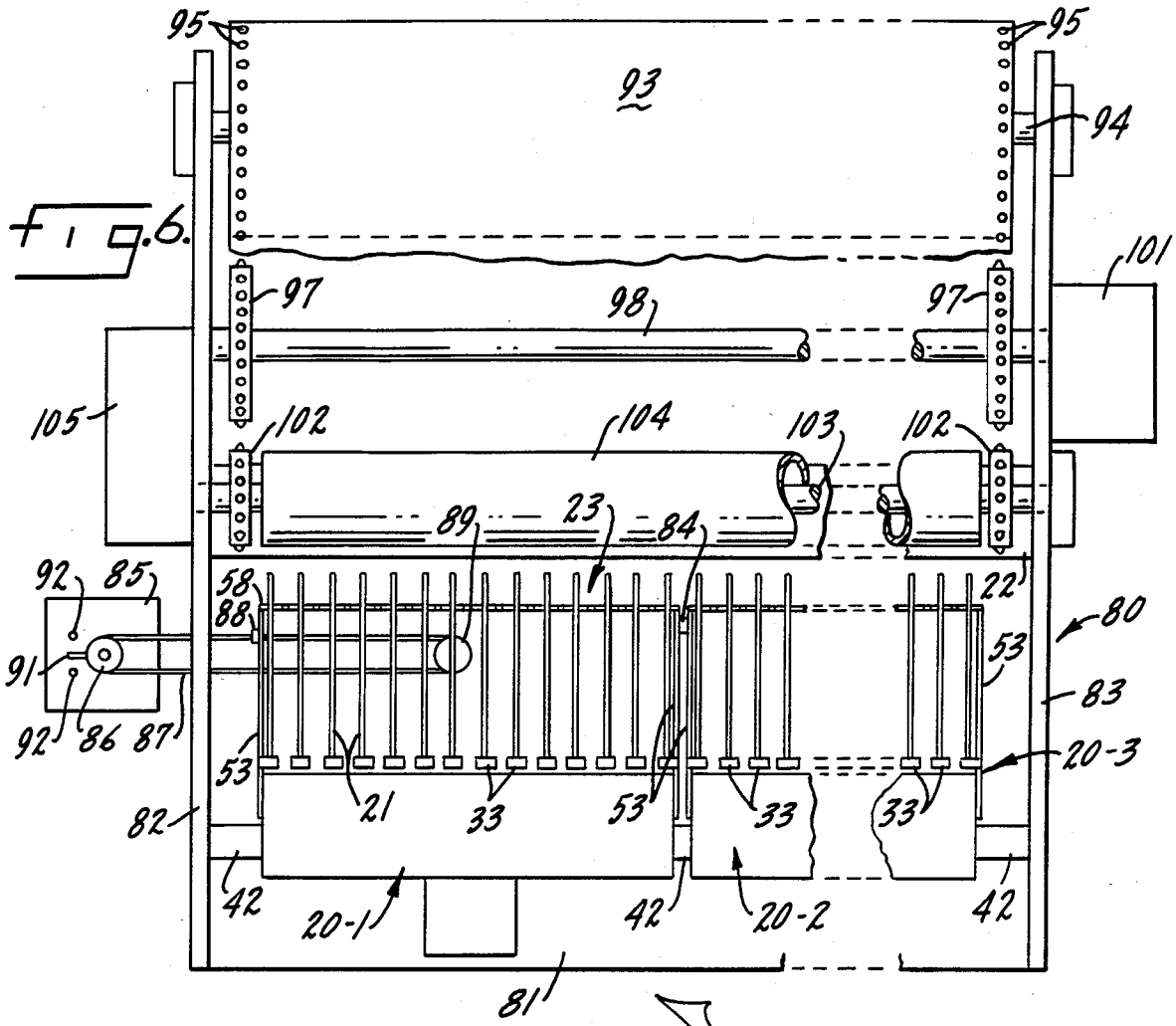
FIG. 6 is a simplified plan view of a dot matrix line printer incorporating a sprocket paper feed and three print element driver assemblies of the kind shown in FIGS. 1–3.
Figure 7:
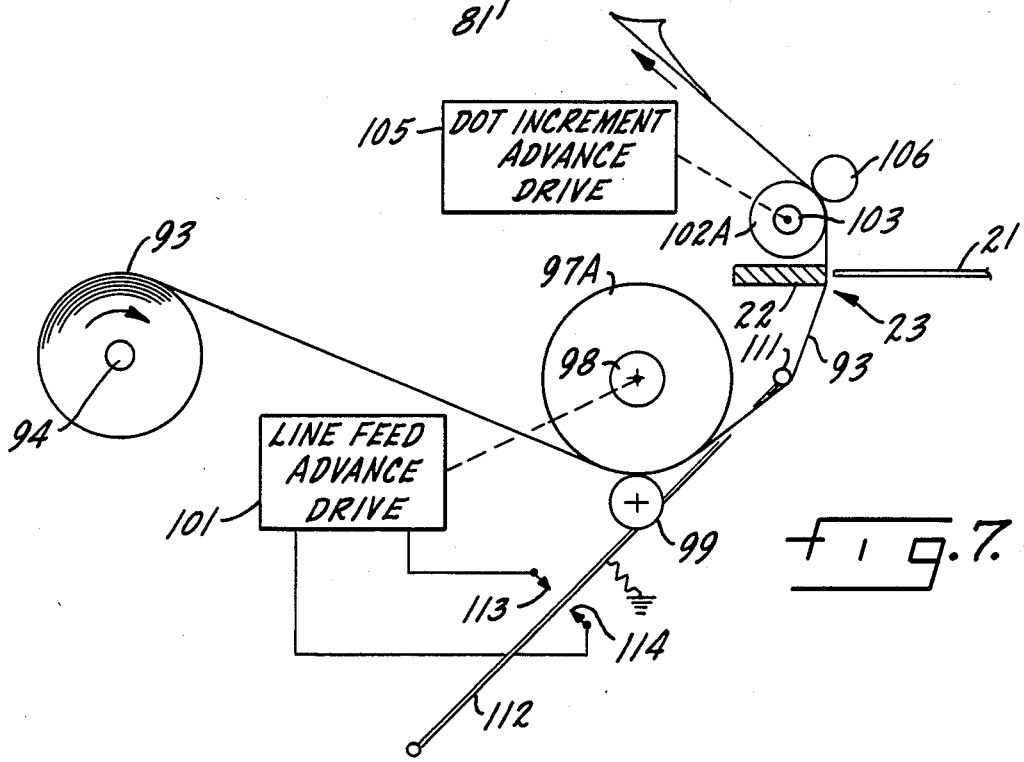
FIG. 7 is a schematic side elevation view of a friction paper feed mechanism for a printer like that shown in FIG. 6.

FIG. 6 provides a plan view of a dot matrix line printer 80, using a sprocket paper feed, which incorporates three modular print element driver assemblies 20-1, 20-2, and 20-3, all duplicating the construction described above in connection with FIGS. 1-5. FIG. 7 affords a schematic side elevation view of a friction paper feed mechanism that could be used in printer 80.

Printer 80 (FIG. 6) includes a frame comprising a base plate 81 and two side plates 82 and 83. The print element driver assembly 20-1, 20-2 and 20-3 are all mounted on a common support member 42 that extends between the two side frame members 82 and 83. Each of the print element driver assemblies in printer 80 includes fourteen print elements 21 driven by armatures 33 and the spacing between adjacent print elements is again made equal to a total of two character widths so that the printer can print a line of text having a total length of eighty-four characters, quite suitable for a paper web having the width of conventional stationery, eight and one-half inches. The shuttle support arms 53 of print element driver assemblies 20-1 and 20-2 are joined by a connector 84 and a similar connector (not shown) joins the shuttles of the driver assemblies 20-2 and 20-3.

Printer 80, FIG. 6, includes a stepper motor 85 utilized as a drive motor for the shuttles of the print element driver assemblies in the printer. A pulley 86 mounted on the shaft of motor 85 engages a drive belt 87 that is connected to one support arm 53 of shuttle 20-1 by a connector 88. Belt 87 also engages an idler pulley 89 mounted on base plate 81. An arm 91 mounted on the shaft of motor 85 is engageable with two fixed stops 92 that determine the range of rotational movement for the motor shaft and hence determine the limits of scanning movement for belt 87 and the shuttles driven by that belt.

A paper supply roll 93 is mounted on a shaft 94 that extends across frame members 82 and 83. Printer 80 is a sprocket feed printer and the paper roll 93 is shown as providing sprocket apertures 95 in both edges of the paper. It should be understood, however, that a friction feed can also be utilized for the paper in printer 80 and such a friction feed is illustrated in FIG. 7. From the supply roll, the paper web 93 extends into engagement with two line increment feed sprockets 97 mounted on a shaft 98 that extends across printer 80 between frame members 82 and 83 (FIG. 6). In the friction feed arrangement of FIG. 7, a feed roll 97A replaces the sprockets 97 of FIG. 6. In the friction feed of FIG. 7, an additional pressure roll 99 may be desirable. For either arrangement, a line increment feed drive motor 101 is provided for shaft 98. A stepper gear motor is preferred for the line increment feed motor 101.

From the line increment feed sprockets 97 (FIG. 6) the paper web is extended past platen 22, which extends across printer 80 between frame members 82 and 83, and into engagement with two dot increment feed sprockets 102 mounted on a shaft 103 that extends across printer 80 closely adjacent to the platen. A paper guide tube 104 may be rotatably mounted upon shaft 103 for guidance of the central portion of the paper web. The dot increment feed shaft 103 is connected to a drive motor 105 which, again, is preferably a stepper gear motor. In the friction feed arrangement of FIG. 7, a feed roll 102A on shaft 103 replaces the sprockets 102; again, an additional pressure roll 106 may be utilized.

In a dot matrix line printer such as printer 80 (FIG. 6) the paper web must be fed accurately and rapidly in very small increments. Because the paper supply may be derived from a relatively large roll, as shown in FIG. 6, or from a fan-fold carton supply, with the need for lateral straightening frequently present, the problem of assuring a precision paper feed becomes rather complex and may lead to costly solutions. These difficulties are overcome, in printer 80, with a relatively simple and inexpensive paper feed mechanism.

In printer 80 both the line increment feed drive motor 101 and the dot increment feed drive motor 105 are activated at the time that printing of each line of text is initiated. After each line of dots (for a single character line) is printed, drive 105 advances the paper by a small incremental distance approximately corresponding to the height of one dot. During the time interval in which the line of text is printed, the line feed drive 101 remains energized, advancing the paper web at the same average rate as the dot increment drive 105. Thus, the line feed paper advance means comprising motor 101, shaft 98, and sprockets 97 is energized continuously and cyclically advances the paper web, on a line-by-line basis, from the supply roll toward platen 22 at the print station 23 of the printer, whereas the dot increment paper advance means comprising motor 105, shaft 103, and sprockets 102 cyclically pulls the paper web through the print station in a series of incremental movements with each increment approximately equal to one dot height; the line feed cycle and the dot incremental feed cycle are coordinated so that the two paper feed advance means each advance the paper at the same average rate.

The friction drive illustrated in FIG. 6 functions in essentially the same manner. In this instance, the line feed advance is provided by roll 97A and the incremental dot height paper feed is afforded by roll 102A. The coarse line feed, roll 97A, responds to a succession of pulses on a slew basis, not stopping until it has fed paper into print station 23 for the full height of a line of text. The dot incremental paper feed afforded by roll 102A steps the paper in dot-height increments past print station 23, stopping after each step.

For the dot incremental print feed paper advance driven by motor 105 there is no appreciable paper drag. To avoid cumulative error between the two paper drives, particularly in a friction feed arrangement such as that shown in FIG. 7, an additional control may be desirable. This control is afforded by slack detector means including a rod 111 that engages the paper web between feed roll 97A and print station 23. Rod 111 is pivotally mounted upon a pair of spring support arms 112. The support arms 112 are electrically connected to a source of reference potential, indicated as ground. Furthermore, one of the arms 112 is engageable with either one of two electrical contacts 113 and 114. Engagement of arm 112 with contact 113 indicates inadequate paper length between rolls 97A and 102A. If arm 112 engages contact 114 on the other hand, it indicates excessive length in the portion of the paper web between roll 97A and platen 22. The electrical contacts 113 and 114 are connected to the line feed advance drive 101 in a control circuit arrangement, not shown in detail, that causes the addition of a count to the cycle for the step motor of the line feed paper advance for each cycle of operation. Engagement with contact 114, on the other hand, deletes one step per line feed advance cycle. Thus, the slack detector 111–114 affords an effective input for a tension control for that portion of the paper web between roll 97A and platen 22 to incrementally increase the line feed cycle in response to a detection of excessive length in this portion of the paper web and incrementally decrease the line feed cycle in response to a detection of inadequate length.

In the foregoing description it is assumed that each incremental shuttle movement used in scanning the dot print line is equal to a full dot width. This need not be the case; smaller incremental movements (e.g., one-half dot width) may be utilized for high quality printing. Similarly, the paper advance increments may be made one-half dot height for improved print quality, at the cost of doubling the number of dot lines required to print a full line of text.

FIG. 8 affords a partially schematic sectional side elevation view of a printhead 220 for use in a column sequential dot matrix printer, the printhead 220 incorporating many of the features of the line printer driver assembly 20 of FIGS. 1–3. Printhead 220 incorporates N electromagnets 226, with N equal to the number of rows in the dot matrix to be reproduced by the printhead. Typically, N may range from seven to twelve. In this instance, the electromagnets are disposed in a circular array about a printhead axis 210. Each electromagnet 226 drives a print element 221 in printing a line of text on a paper sheet 224 supported upon a conventional cylindrical platen 222.

Electromagnets 226 utilize the same construction as in FIGS. 1–3. Thus, each electromagnet 226 incorporates an electrical coil 229 mounted upon one of two magnetic core members 231 and 232. In each electromagnet the end faces 227 and 228 of the two core members are spanned by an armature 233 mounted on the free end of a cantilever bias and support spring 246. In printhead 220 the armature bias springs 246 are anchored to a support ring 248. Continuous progressive spring stops 251 may be used.

All of the outer core members 231 for electromagnets 226 are affixed to a magnetic bus 235 of circular configuration. All of the inner core members 232 are affixed to a ring-shaped inner magnetic bus 236. The magnetic buses 235 and 236 are spaced from each other by a non-magnetic spacer ring 237 to afford the requisite common passive air gap in the magnetic structure. A permanent magnet 244 is connected across the two magnetic buses 235 and 236.

As will be apparent, the operation of printhead 220, FIG. 8, is the same as print element driver assembly 20 (FIGS. 1–3) with respect to actuation of each of the print rods 221 through a printing movement. That is, each armature 233 is normally held in an initial attracted position immediately adjacent to the associated poles 227 and 228 of the electromagnet 226 by the magnetic attraction force afforded by permanent magnet 244; this is the position shown for the lowermost armature 233 and print rod 221 in FIG. 8. Energization of one of the coils 229, however, establishes an electromagnet flux that effectively cancels the permanent magnet flux to release any one of the armatures 233 for movement to a print position; the released position is shown for the uppermost armature 233 and associated print rod 221 in FIG. 8. The passive air gap afforded by spacer 237 performs the same function in printhead 220 as in the previously described embodiments.

FIG. 9 is a simplified sectional elevation view of a print element driver assembly 320 for a dot matrix line printer comprising another embodiment of the invention; assembly 320 incorporates many of the features of the previously described driver assembly 20 and printhead 220. The print element driver assembly 320 includes N electromagnets 326 (only one is shown) in a linear array like that of FIGS. 1–3. Each electromagnet 326 comprises a core member or pole piece 331 having a surface 327 at one end; a coil 329 is mounted on the core member. An armature 333 is aligned with magnet pole 327. Armature 333 is integral with and constitutes the free end of a cantilever armature bias and support spring 346 that is formed of low reluctance spring steel.

The local magnetic circuits for all of the electromagnets 326 are connected by two magnetic buses 335 and 336 which are spaced from each other by a non-magnetic spacer 327 to afford a passive, bypass air gap common to all of the electromagnet circuits. In this embodiment the magnetic bus 336 is a part of a frame 339 on which the lower end of the armature bias spring 346 is mounted. A curved stop member 351 on frame 339 engages spring 346, the relationship being as described above for spring 46 and stop 51 (see FIGS. 3 and 5B).

In assembly 320, FIG. 9, a short dot print element 321 is mounted on the armature portion 333 of spring 346 for each electromagnet 326. Thus, there are N print elements 321, and these print elements are aligned with a platen 322 and paper 324 at a print station 323, just as in the prior embodiment.

Operation of driver assembly 320 in printing dots on paper 324 is essentially the same as for assembly 20. All of the armatures 333 start at the attracted position shown in solid lines in FIG. 9, held there by the magnetic attraction afforded by a permanent magnet 344 connected to the magnetic connection buses 335 and 336, across the common passive air air gap 338. Energization of one of the coils 329 produces an electromagnetic flux that effectively cancels the permanent magnet flux in one local electromagnet circuit, releasing the associated armature 333 to move through its released position 333A to drive its print element 321 into contact with paper 324, printing a dot. When the coil is de-energized, armature 333 is again pulled back to the attracted position adjacent surface 327, with stop 351 controlling that movement by progressively shortening the effective length of spring 346.

The magnetic connection buses 335 and 336 and passive air gap 338 in assembly 320 serve the same useful purposes as buses 35 and 36 and gap 38 in assembly 20. The electromagnetic flux is not required to pass through permanent magnet 344 so that small coils operating at low currents are quite adequate for effective operation. As before, the reluctance of the passive air gap 338 provided by spacer 337 is preferably of the order of 1/N times the maximum reluctance of the working air gap for any one of the armatures 333, which occurs when the armature is at its released position 333A.

I claim:

1. An electromagnetic/permanent magnet driver assembly for a recorder, the driver assembly comprising:

N electromagnets, each electromagnet including an armature, magnetic core means affording an individual local magnetic circuit, and an electrical coil mounted on the core means for generating electromagnetic flux in the local magnetic circuit, the magnetic circuit including:

a variable working air gap with which the armature is aligned for movement between an attracted position and a released position to actuate a recording element;

and a constant local passive air gap that is separate from and independent of the working air gap;

the driver assembly further comprising:

magnetic circuit connection means interconnecting all of the individual local magnetic circuits with their individual local passive air gaps in parallel, to form a constant common passive air gap;

and a permanent magnet connected to the magnetic circuit connection means, across the common passive air gap;

the common passive air gap being connected in series with the working air gap for each electromagnet and in parallel with the working air gaps for the permanent magnet, affording an effective shunt bypassing the permanent magnet for each electromagnet.

2. A driver assembly according to claim 1 and further comprising armature bias means individually biasing each armature toward its released position.

3. A driver assembly according to claim 1 in which the reluctance of the common passive air gap is of the order of 1/N times the maximum reluctance of the effective working air gap for each electromagnet.

4. A driver assembly according to claim 2 in which the armature bias means comprises:

N cantilever armature bias springs each supporting its associated armature on the free end of the spring;

and stop means, engaging the armature bias springs, for limiting movement of each armature from its released position toward its attracted position to thereby determine the attracted position for the armature, the stop means comprising a stop member, constantly engaged by the armature bias spring, having a configuration such that it engages successive points each further displaced from the fixed end of the spring to progressively reduce the effective length of the spring as the associated armature moves toward its attracted position.

5. A drivbr assembly according to claim 4 in which the reluctance of the conmon passive air gap is of the order of 1/N times the maximum reluctance of the effective working air gap for each electromagnet.

6. A driver assembly according to claim 2 in which the magnetic core means for each electromagnet comprises first and second individual core members, each having a working gap end and a circuit connection end, with each armature spanning the two working gap ends to afford a two-part working air gap, and in which the magnetic circuit connection means comprises:

a first magnetic bus connected to the circuit connection ends of all of the first core members and to one pole of the permanent magnet;

and a second magnetic bus connected to the circuit connection ends of all of the second core members and to the other pole of the permanent magnet;

the two magnetic buses being disposed in spaced relation to each other and defining the common passive air gap therebetween.

7. A driver assembly according to claim 6 in which the armature bias means comprises:

N cantiliver armature bias springs each supporting its associated armature on the free end of the spring;

and stop means, engaging the armature bias springs, for limiting movement of each armature from its released position toward its attracted position to thereby determine the attracted position for the armature, the stop means comprising a stop member, constantly engaged by the armature bias spring, having a configuration such that it engages successive points each further displaced from the fixed end of the spring to progressively reduce the effective length of the spring as the associated armature moves toward its attracted position.

8. A driver assembly according to claim 7 in which the reluctance of the common passive air gap is of the order of 1/N times the maximum reluctance of the effective working air gap for each electromagnet.

9. A driver assembly according to claim 1, for use in a dot matrix printer in which each recording element is an elongated, essentially linear print rod and the outer ends of the print rods, remote from the armatures, are aligned along a dot print line M character width spaces from each other, the driver assembly further comprising a shuttle including:

two cantiliver support arms extending parallel to the print rods, with the free ends of the support arms adjacent to but spaced from the opposite ends of the dot print line, each support arm being resilient and flexible in a direction parallel to the dot print line but rigid in any direction transverse to that line;

a shuttle member affixed to and interconnecting the free ends of the support arms;

and N print rod guides, each comprising a cantilever spring affixed to and projecting from the shuttle member and supporting the outer end of one print rod, each guide being resilient and flexible in a direction permitting axial movement of its associated print rod but rigid in any direction transverse thereto.

10. A driver assembly according to claim 9 in which the entire shuttle, including the support arms, shuttle member, and print rod guides, is formed from a single, thin, unitary sheet of resilient metal.

11. A driver assembly according to claim 9 and further comprising a rigid frame with the electromagnets, the magnetic circuit connection means, and the permanent magnet all mounted on the frame, and with the fixed ends of the shuttle support arms affixed to the frame.

12. A driver assembly according to claim 9 in which the armature bias means comprises:

N cantilever armature bias springs each supporting its associated armature on the free end of the spring;

and stop means, engaging the armature bias springs, for limiting movement of each armature from its released position toward its attracted position to thereby determine the attracted position for the armature, the stop means comprising a stop member, constantly engaged by the armature bias spring, having a configuration such that it engages successive points each further displaced from the fixed end of the spring to progressively reduce the effective length of the spring as the associated armature moves toward its attracted position.

13. A driver assembly according to claim 12 in which the reluctance of the common passive air gap is of the order of 1/N times the maximum reluctance of the effective working air gap for each electromagnet, and in which M=2.

14. A driver assembly according to claim 9 in which the magnetic core means for each electromagnet comprises first and second individual core members, each having a working gap end and a circuit connection end, with each armature spanning the two working gap ends to afford a two-part working air gap and in which the magnetic circuit connection means comprises:

a first magnetic bus connected to the circuit connection ends of all of the first core members and to one pole of the permanent magnet;

and a second magnetic bus connected to the circuit connection ends of all of the second core members and to the other pole of the permanent magnet;

the two magnetic buses being disposed in spaced relation to each other and defining the common passive air gap therebetween.

15. A driver assembly according to claim 14 in which the reluctance of the common passive air gap is of the order of 1/N times the maximum reluctance of the effective working air gap for each electromagnet.

16. In a dot matrix line printer of the kind comprising N elongated dot print rods, each having a drive end and a print end, the print ends of the print rods being aligned in spaced relation to each other along a dot print line across a recording sheet of paper or the like at a print station, and drive means including N electromagnet armatures each connected to the drive end of a print rod, the improvement comprising:

a frame;

N armature support members, each comprising a cantilever spring having a fixed end anchored to the frame and a free end supporting one of the armatures;

a shuttle member parallel to but spaced from the dot print line;

N print rod support and guide members, each comprising a cantilever spring having a fixed end anchored to the shuttle member and a free end supporting the print end of one print rod, the print rod guide members being flexible and resilient only in a direction allowing axial motion of the print rods;

and two cantilever spring shuttle support arms, each having a fixed end anchored to the frame and a free end supporting one end of the shuttle, each support arm being resilient and flexible only in a direction parallel to the dot print line.

17. A dot matrix line printer according to claim 16 in which the support arms, the shuttle member, and the print rod guide members are all formed from a single, thin, unitary sheet of resilient metal.

18. A dot matrix line printer according to claim 16 and further comprising:

stop means, on the frame, for limiting movement of the armature toward an attracted position;

the stop means comprising a stop member continuously engaged by each of the armature support members, having a configuration such that it engages successive points each further displaced from the fixed end of the support member to progressively reduce the effective length of the support member as the associated armature moves toward its attracted position.

19. A dot matrix line printer according to claim 18 in which the support arms, the shuttle member, and the Print rod guide members are all formed from a single, thin, unitary sheet of resilient metal.

20. A dot matrix line printer according to claim 16 including PN print elements and PN electromagnets arranged in P assemblies each including N print element driver electromagnets and N print elements, and in which:

each electromagnet includes an armature, magnetic core means affording an individual local magnetic circuit, and an electrical coil mounted on the core means for generating electromagnetic flux in the local magnetic circuit, the magnetic circuit including:

a variable working air gap with which the armature is aligned for movement between an attracted position and a released position to actuate a recording element;

and a constant local passive air gap that is separate from and independent of the working air gap;

magnetic circuit connection means interconnecting all of the individual local magnetic circuits of each assembly with their individual local passive air gaps in parallel, to form a constant common passive air gap for that assembly;

and a permanent magnet connected to the magnetic circuit connection means, across the common passive air gap, in each assembly;

the common passive air gap in each assembly being connected in series with the working air gap for each electromagnet in that assembly and in parallel with the working air gaps for the permanent magnet of that assembly, affording an effective shunt bypassing the permanent magnet for each electromagnet.

21. A dot matrix line printer according to claim 20 in which the reluctance of the common passive air gap in each assembly is of the order of 1/N times the maximum reluctance of the effective working air gap for each electromagnet.

* * * * *